US006326551B1

(12) United States Patent
Adams

(10) Patent No.: US 6,326,551 B1
(45) Date of Patent: Dec. 4, 2001

(54) MOISTURE-ABSORBING COAXIAL CABLE AND METHOD OF MAKING SAME

(75) Inventor: Scott M. Adams, Catawba, NC (US)

(73) Assignee: CommScope Properties, LLC, Sparks, NV (US)

( * ) Notice: Subject to any disclaimer, the term of this patent is extended or adjusted under 35 U.S.C. 154(b) by 0 days.

(21) Appl. No.: 09/326,049

(22) Filed: Jun. 4, 1999

Related U.S. Application Data

(63) Continuation-in-part of application No. 08/911,538, filed on Aug. 14, 1997, now abandoned.

(51) Int. Cl.[7] ..... H01B 12/12
(52) U.S. Cl. ..... 174/113 C
(58) Field of Search ..... 174/28, 36, 105 R, 174/107, 110 F, 110 PM, 113 C, 131 A, 23 R, 106 R, 121 A

(56) References Cited

U.S. PATENT DOCUMENTS

| | | | |
|---|---|---|---|
| Re. 30,715 | | 8/1981 | Woytiuk . |
| 527,414 | | 10/1894 | Dewees . |
| 1,904,887 | | 4/1933 | Shee . |
| 2,222,748 | | 11/1940 | Komives et al. . |
| 2,507,508 | | 5/1950 | Elliott et al. . |
| 3,193,712 | | 7/1965 | Harris . |
| 3,309,455 | | 3/1967 | Mildner . |
| 3,340,353 | | 9/1967 | Mildner . |
| 3,588,317 | | 6/1971 | Hutchins, Jr. . |
| 3,643,007 | | 2/1972 | Roberts et al. . |
| 3,679,810 | | 7/1972 | Nutt . |
| 3,717,719 | | 2/1973 | Smith et al. . |
| 3,999,003 | | 12/1976 | Chevrolet et al. . |
| 4,004,077 | | 1/1977 | Woytiuk . |
| 4,029,830 | * | 6/1977 | Yamamoto et al. ..... 174/110 PM |
| 4,104,481 | | 8/1978 | Wilkenloh et al. . |
| 4,238,638 | | 12/1980 | Cretney et al. . |
| 4,333,706 | | 6/1982 | Davis et al. . |
| 4,399,322 | * | 8/1983 | Hafner, Jr. ..... 174/107 X |
| 4,472,595 | | 9/1984 | Fox et al. . |
| 4,701,575 | | 10/1987 | Gupta et al. . |
| 4,707,569 | * | 11/1987 | Yoshimura et al. ..... 174/110 F |
| 4,815,813 | | 3/1989 | Arroyo et al. . |
| 4,867,526 | | 9/1989 | Arroyo . |
| 4,909,592 | | 3/1990 | Arroyo et al. . |
| 4,953,946 | | 9/1990 | Huybrechts . |
| 4,963,695 | | 10/1990 | Marciano-Agostinelli et al. . |
| 5,010,209 | | 4/1991 | Marciano-Agostinelli et al. . |
| 5,068,497 | | 11/1991 | Krieger . |
| 5,082,719 | | 1/1992 | Arroyo . |

(List continued on next page.)

FOREIGN PATENT DOCUMENTS

| | | |
|---|---|---|
| 448670 | 5/1948 | (CA) . |
| 0504776 | 9/1992 | (EP) . |
| 2637127 | 3/1990 | (FR) . |
| WO 97 45844 | 12/1997 | (WO) . |

OTHER PUBLICATIONS

Announcement from Belden entitled Composite Braid: Metallic Wire and Water Expandable Yarn (Patent Pending), California Cable Association 1996 Western Show, Dec. 11–13, 1996 (trade show).

*Primary Examiner*—Chau N. Nguyen
(74) *Attorney, Agent, or Firm*—Alston & Bird LLP

(57) ABSTRACT

The present invention provides a coaxial cable having increasing moisture absorbency to remove moisture present in the cable and to prevent corrosion of the conductors in the cable. The coaxial cable of the invention includes an inner conductive tube, a moisture-absorbent material within the inner conductive tube, a dielectric surrounding the inner conductive tube, and a tubular metallic outer sheath surrounding the dielectric. The present invention further includes a method of making a coaxial cable that is capable of absorbing moisture that is present in the cable.

31 Claims, 5 Drawing Sheets

U.S. PATENT DOCUMENTS

| | | | |
|---|---|---|---|
| 5,131,064 | | 7/1992 | Arroyo et al. . |
| 5,133,034 | | 7/1992 | Arroyo et al. . |
| 5,210,377 | | 5/1993 | Kennedy et al. . |
| 5,235,299 | | 8/1993 | Vaille et al. . |
| 5,246,770 | | 9/1993 | Bottiglione et al. . |
| 5,256,705 | | 10/1993 | Freeman . |
| 5,266,744 | | 11/1993 | Fitzmaurice . |
| 5,274,712 | | 12/1993 | Lindsay et al. . |
| 5,306,867 | | 4/1994 | Connole et al. . |
| 5,373,100 | | 12/1994 | Arroyo et al. . |
| 5,461,195 | | 10/1995 | Freeman et al. . |
| 5,481,635 | | 1/1996 | Arroyo et al. . |
| 5,486,648 | | 1/1996 | Chan et al. . |
| 5,500,488 | | 3/1996 | Buckel . |
| 5,521,331 | | 5/1996 | Hillburn . |
| 5,796,042 | | 8/1998 | Pope . |
| 5,796,043 | * | 8/1998 | Maruyama ..... 174/102 SC |
| 5,949,018 | * | 9/1999 | Esker ..... 174/23 R |

* cited by examiner

MOISTURE-ABSORBING COAXIAL CABLE AND METHOD OF MAKING SAME

CROSS-REFERENCE TO RELATED APPLICATIONS

This application is a continuation-in-part of U.S. patent application Ser. No. 08/911,538 to Moe et al., filed Aug. 14, 1997 now abandoned, which is incorporated herein by reference in its entirety.

FIELD OF THE INVENTION

The present invention relates to a coaxial cable, and more particularly to an improved low-loss coaxial cable having good moisture-absorbing, bending, handling and electrical properties.

BACKGROUND OF THE INVENTION

The coaxial cables commonly used today for the transmission of RF signals, such as cable television signals and cellular telephone broadcast signals, include a core containing an inner conductor, a metallic sheath surrounding the core and serving as an outer conductor, and in some instances a protective jacket that surrounds the metallic sheath. A dielectric surrounds the inner conductor and electrically insulates it from the surrounding metallic sheath. In many known coaxial cable constructions, an expanded foam dielectric surrounds the inner conductor and fills the space between the inner conductor and the surrounding metallic sheath.

The design of coaxial cables has traditionally been a balance between the electrical properties (e.g., high signal propagation, and low attenuation) and the mechanical or bending properties of the cable. For example, in some coaxial cable constructions, air and plastic spacers are used between the inner conductor and the outer conductor to reduce attenuation and increase signal propagation of the cable. Nevertheless, the plastic spacers that are placed between the inner and outer conductors do not adequately support the outer conductor in bending. Thus, the outer conductor is subject to buckling, flattening or collapsing during bending which can render the cable unusable. One alternative has been to use a foam dielectric between the inner and outer conductors as described above. However, although the bending properties are improved, the rate at which the signals are propagated is typically reduced.

One recent advance in the coaxial cable industry for RF cables has been the construction of larger diameter cables. Larger diameter cables generally possess a greater average power rating and reduced attenuation over relatively smaller diameter cables. Unfortunately, however, because these cables have large diameters, they are typically not as flexible as their smaller diameter counterparts. As a result, there is a greater level of difficulty in installing these cables.

Another problem with larger diameter cables and cables generally is that moisture in the cable can corrode the conductors thus negatively affecting the electrical and mechanical properties of the cable. In particular, during installation of the cable, moisture can enter the cable at the connectors. This moisture can also travel within the cable through the foam or air dielectric or along interfaces in the cable, e.g., between a foam dielectric and a metallic sheath.

Several methods have been proposed to prevent moisture from entering the cable and being transported through the cable. For example, hydrophobic, adhesive compositions have been applied at interfaces in the cable to prevent moisture from moving along these interfaces. Water-blocking compositions have also been used at other locations in the cable to limit water transport in the cable. In addition, hydrophilic, moisture-absorbent materials have been used in cables to act as water-blocking materials. These hydrophilic materials not only water-block the cable but also remove moisture that is present in the cable.

Copending U.S. patent application Ser. No. 08/911,538 to Moe et al., filed on Aug. 14, 1997, which has been incorporated herein in its entirety by reference, proposes a new cable construction using an inner conductive tube thus reducing the cost of the cable and providing a cable with good flexibility. Although this new construction provides numerous benefits, using an inner conductive tube creates the possibility of moisture moving through the cable. In particular, moisture can enter the tube during connectorization especially in moist conditions. This moisture can be transported within the inner conductive tube thereby causing corrosion of the inner conductive tube. Therefore, there is a need in the art to avoid moisture transmission in this region of the cable and the attendant potential effects upon the electrical and mechanical properties of the cable.

SUMMARY OF THE INVENTION

The present invention provides a coaxial cable having good moisture-absorbing and water-blocking properties thereby limiting the negative effects of moisture on the electrical and mechanical properties of the cable and allowing the cable to maintain its signal transmission performance over time. Furthermore, the moisture-absorbent materials used in the cable typically bind the moisture away from the electrically conducting surfaces of the cable to prevent corrosion of these surfaces. The cables of the invention have excellent electrical properties, flexibility and bending properties. In addition, these cables avoid buckling, flattening or collapsing in bending, even in larger diameter cable designs. The coaxial cable of the invention can also be easily connectorized and can be produced at low cost.

The present invention provides a coaxial cable comprising an inner conductive tube, a moisture-absorbent material within the inner conductive tube, a dielectric surrounding the inner conductive tube, and a tubular metallic outer sheath surrounding the dielectric. The inner conductive tube can be supported with a plastic rod adjacent an inner surface of the inner conductive tube and the moisture-absorbent material is preferably provided between the plastic rod and the inner conductive tube or within the plastic rod. The plastic rod preferably comprises a foamed polymeric material but can be a solid polymeric material. In addition, the plastic rod can include a foamed polymeric layer and a solid polymeric layer surrounding the foamed polymeric layer with the moisture-absorbent material present either in the foamed polymeric layer or between the foamed polymeric layer and solid polymeric layer. The plastic rod can also be adhesively bonded to the inner conductive tube to provide water blocking at the interface between the plastic rod and the inner conductive tube.

In one embodiment of the invention, the plastic rod is a hollow plastic rod that includes a central structural member adjacent an inner surface of the plastic rod and that supports the plastic rod. In this embodiment, the moisture-absorbent material is preferably provided within the central structural member or on an interface between the central structural member and the inner surface of the plastic rod. The central structural member is preferably a fiber reinforced plastic rod or a metal wire. The central structural member can also include more than one moisture-absorbent material with each moisture-absorbent material having different characteristics or rates of moisture absorbency.

In another embodiment of the invention, a moisture-absorbent material layer is present adjacent the inner surface of the inner conductive tube and preferably in direct contact with the adhesive composition that contacts the inner surface of the inner conductive tube. Alternatively, a textile material such as a wick of woven cotton yarn can be provided within the inner conductive tube. This textile material could also include other moisture-absorbent materials that remove moisture in the cable.

The present invention also provides a method of making a coaxial cable. An inner conductive tube that includes a moisture-absorbent material adjacent an inner surface of the inner conductive tube is advanced along a predetermined path of travel. A polymer composition is applied onto the inner conductive tube and a tubular metallic outer sheath is formed onto and encircles the polymer composition to define a dielectric between the inner conductive tube and the outer sheath. The inner conductive tube can be provided by advancing a plastic rod comprising a moisture-absorbent material along a predetermined path of travel and forming the inner conductive tube onto the plastic rod. In this embodiment, the moisture-absorbent material can be applied to an outer surface of the plastic rod or the plastic rod can be extruded from a foamable composition comprising a polymeric material and a moisture-absorbent material. In addition, the plastic rod can be extruded as a foamed polymeric layer surrounded by a solid polymeric layer and the moisture-absorbent material can be extruded with the foamable polymer composition or can be applied to the foamed polymeric layer prior to extruding the solid polymer composition. The plastic rod can also be adhesively bonded to the inner conductive tube.

In one method embodiment of the invention, the plastic rod can be formed by advancing a central structural member along a predetermined path of travel and extruding a polymer composition onto the central structural member. In this embodiment, the central structural member can be a desiccant-filled reinforcing member or the moisture-absorbent material can be applied to the central structural member prior to extruding the polymer composition onto the central structural member to form the plastic rod.

In another method embodiment of the invention, a metal strip can be advanced along a predetermined path of travel, a moisture-absorbent material applied to an inner surface of the metal strip, and the metal strip formed into the inner conductive tube. Alternatively, a metal strip can be formed into an inner conductive tube around an advancing textile material formed of a moisture-absorbent material. The textile material can also be installed inside the inner conductive tube during connectorization of the cable.

These and other features of the present invention will become more readily apparent to those skilled in the art upon consideration of the following detailed description and accompanying drawings that describe both the preferred and alternative embodiments of the invention.

DETAILED DESCRIPTION OF THE INVENTION

Figure 1:
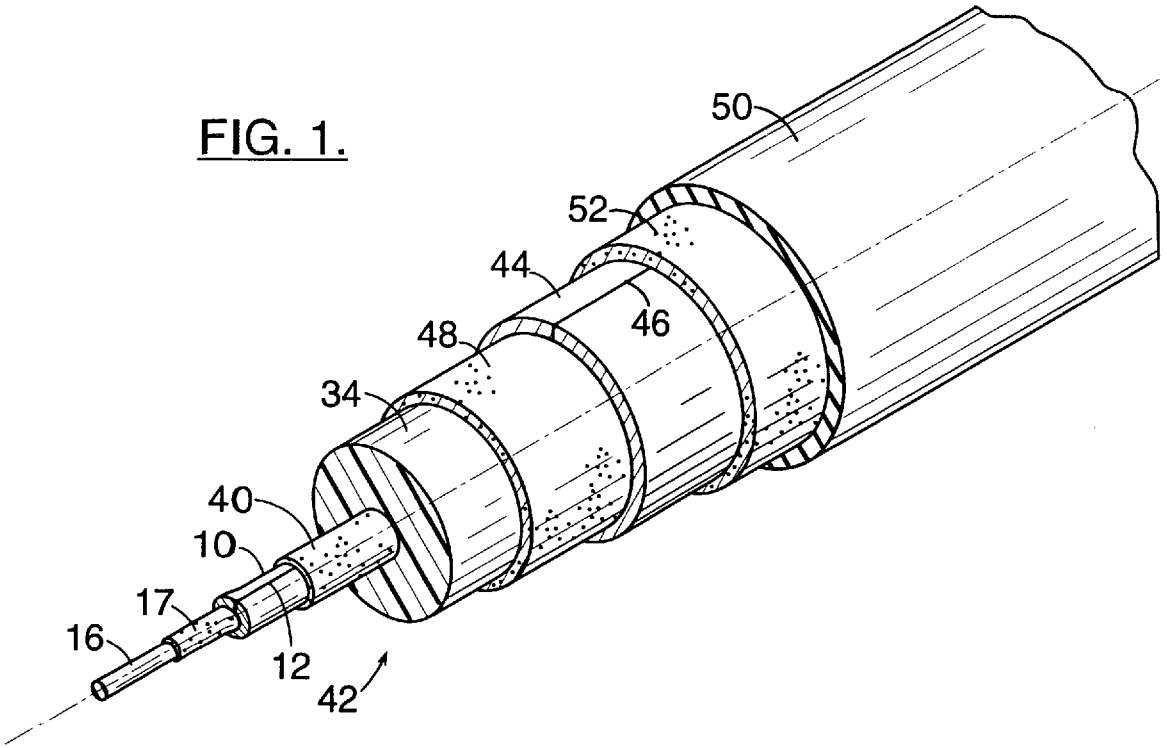
FIG. 1 is a perspective view showing a coaxial cable in accordance with the present invention in cross-section and with portions of the cable broken away for clarity of illustration.

FIG. 1 illustrates a coaxial cable produced in accordance with the present invention. The coaxial cable comprises an inner conductive tube 10. Preferably, the inner conductive tube 10 is formed of a suitable electrically conductive material such as copper. The inner conductive tube 10 can be smooth-walled or corrugated but is preferably smooth-walled as this provides better electrical performance for the cable. Preferably, the inner conductive tube 10 is longitudinally applied, e.g., by forming a metallic strip S1 into a tubular configuration with opposing side edges of the metallic strip butted together, and with the butted edges continuously joined by a continuous longitudinal weld 12. The longitudinal weld 12 is preferably formed by a high frequency induction welding process but can also be formed by other methods known in the art such as by other welding methods (e.g. gas tungsten arc welding or plasma arc welding). In addition, the inner conductive tube 10 can be formed by other processes such as overlapping the metallic strip S1 or by providing a previously formed, continuous metallic tube.

In accordance with the present invention, a moisture-absorbent material is provided within the inner conductive tube 10, i.e., radially inward from an inner surface 14 of the inner conductive tube. Preferably, this moisture-absorbent material does not directly contact the inner surface 14 of the inner conductive tube 10. As a result, the moisture-absorbent material binds moisture away from the inner conductor 10 and prevents corrosion of the inner conductor (and the other conductors in the cable).

The term "moisture-absorbent" material is used herein is defined as a material that absorbs moisture, i.e., liquid water or water vapor, and includes desiccants and other moisture-absorbent, water-swellable, hydrophilic, hygrophobic, and dehumidifying materials. Various commercially available inorganic and organic moisture-absorbent materials can be used within the inner conductive tube 10 in accordance with the invention. Exemplary inorganic moisture-absorbent materials include calcium salts, absorbent clays, silicas and silica gels. Exemplary organic moisture-absorbent materials include natural materials such as agar, pectin, guar gum and synthetic materials such as synthetic hydrogel polymers. These synthetic hydrogel polymers are the preferred moisture-absorbent materials used in the present invention and include, for example, carboxymethylcellulose, hydroxyethylcellulose, hydroxypropylcellulose, alkali metal salts of polyacrylic acids, polyacrylamides, polyvinyl alcohol, ethylene maleic anhydride copolymers, polyvinyl ethers, polymers and copolymers of vinyl sulfonic acid, polyacrylamides, polyacrylates, polyvinyl pyridine, and the like. These moisture-absorbent materials are available as water-swellable powders that are initially dry to the touch but possess a gel-like consistency and swell considerably when exposed to moisture. Typically, the hydrogel polymer material is capable of absorbing at least about 15 times its weight in water, and preferably at least about 25–50 time its weight in water. These hydrogel polymers are also preferably cross-linked to render these materials substantially water-insoluble.

In accordance with the invention, more than one type of moisture-absorbent material can be used within the inner conductive tube 10 with each moisture-absorbent material having different moisture absorptive characteristics or rates. For example, a first moisture-absorbent material can absorb water at a fast rate to remove water that enters the cable during connectorization and installation of the cable and a second moisture-absorbent material can absorb water at a relatively slow rate to remove water present from slow ingress into the cable when the first moisture-absorbent material is saturated. In addition, other combinations of moisture-absorbent materials can be used.

Figure 2:
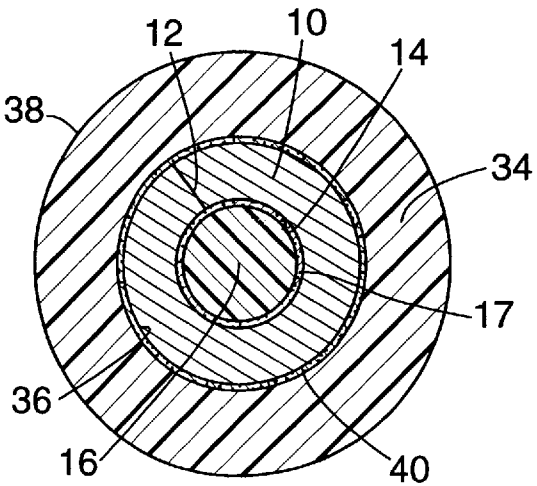
FIG. 2 is a cross-sectional view of a coaxial cable core that includes a moisture-absorbent material within a plastic rod according to one embodiment of the invention.

In a preferred embodiment of the invention and as shown in FIGS. 1 and 2, the inner conductive tube 10 can be supported in bending by a plastic rod 16 adjacent the inner surface 14 of the inner conductive tube. The plastic rod 16 is preferably formed of a material such as polyethylene, polypropylene and polystyrene that will support the inner conductive tube 10 in bending and contribute to the overall compressive strength of the cable. Furthermore, the plastic material of the plastic rod 16 is preferably stable in humid or wet environments. The plastic rod 16 can be a solid plastic material or an expanded closed cell foam polymer material to prevent migration of water through the cable. Preferably, the plastic rod 16 is bonded to the inner conductive tube 10 by an adhesive layer 17. The bond between the plastic rod 16 and inner conductive tube 10 can provide further support to the inner conductive tube in bending and can act as a water blocking layer to prevent moisture from migrating along the inner surface 14 of the inner conductive tube. Exemplary adhesive compositions for use in the adhesive layer 17 are described, e.g., in U.S. Pat. No. 3,309,455 to Mildner and include random copolymers of ethylene and acrylic acid (EAA copolymers), random copolymers of ethylene and methacrylic acid (EMA copolymers) and other copolymers that provide the desired adhesive properties. In addition, the plastic rod can be formed of more than one layer using different materials or having different densities such as the foam plastic layer 18 and the solid plastic layer 20 illustrated as FIG. 3.

Figure 3:
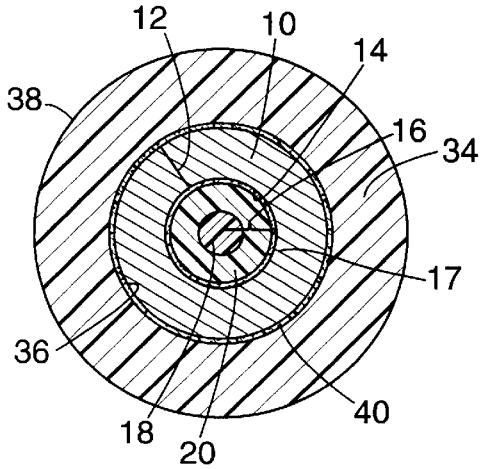
FIG. 3 is a cross-sectional view of a coaxial cable core that includes a moisture-absorbent material within a foam-solid plastic rod according to one embodiment of the invention.

In the embodiments illustrated in FIGS. 1–3, the moisture-absorbent material can be provided at various locations within the inner conductive tube 10. For example, in the embodiment illustrated in FIGS. 1 and 2, the moisture-absorbent material is incorporated in the plastic rod 16. The moisture-absorbent material is typically either combined with the polymer material in masterbatch pellets or added separately to the extruder. In the embodiment illustrated in FIG. 3, the moisture-absorbent material can be provided in the foam plastic layer 18, the solid plastic layer 20, or both. Preferably, the moisture-absorbent material is provided in the foam plastic layer 18 so the moisture-absorbent material has access to any moisture that is present in the cable. Although not shown, the moisture-absorbent material can alternatively be incorporated in the adhesive layer 17. However, it is preferred that the moisture-absorbent material not directly contact the inner conductive tube 10, if possible, so that any moisture incorporated therein will not corrode the inner surface 14 of the inner conductive tube.

Figure 4:
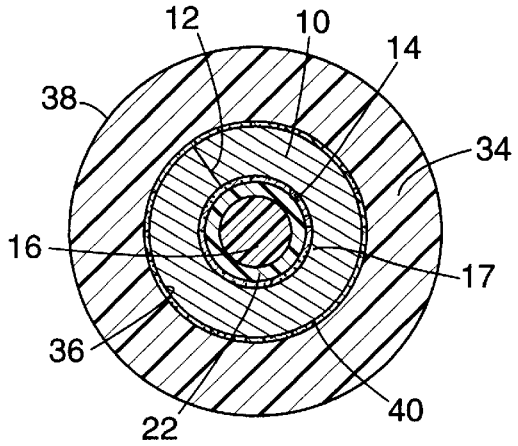
FIG. 4 is a cross-sectional view of a coaxial cable core that includes a moisture-absorbent material at an interface between a plastic rod and an inner conductive tube according to one embodiment of the invention.

Alternatively, as shown in FIG. 4, the moisture-absorbent material can be provided as a moisture-absorbent layer 22 at the interface between the plastic rod 16 and the adhesive layer 17 adjacent the inner surface 14 of the inner conductive tube 10. This moisture-absorbent layer can be applied either to the surface of the plastic rod 16, provided on the adhesive layer 17, or less preferably provided directly on the inner surface 14 of the inner conductive tube 10 when no adhesive layer 17 is included. Preferably, the moisture-absorbent material is a tacky material to cause adherence to the underlying material. The moisture-absorbent material can also be applied soon after the plastic rod 16 or adhesive layer 17 is formed while these materials are still molten to provide adhesion between the moisture-absorbent material and these materials. Alternatively, the moisture-absorbent material can be dispersed or dissolved in a suitable medium and applied to the plastic rod 16 or adhesive layer 17 and the dispersion or solution allowed to dry leaving a coating of the moisture-absorbent material. Another suitable method of forming the moisture-absorbent layer is to apply a textile material such as a non-woven tape that is impregnated with a moisture-absorbent material to the plastic rod 16. As would be understood by those skilled in the art from FIG. 4, a moisture-absorbent layer could also be included in the construction of FIG. 3 either at the interface between the foam plastic layer 18 and the solid plastic layer 20 or at the interface between the solid plastic layer 20 and the adhesive layer 17 (or the inner surface 14 of the inner conductive tube 10 if no adhesive layer 17 is present).

Figure 5:
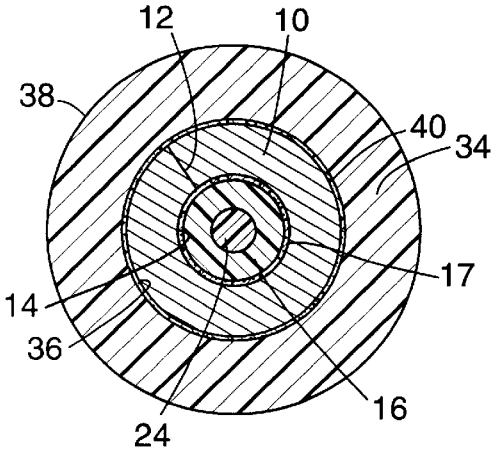
FIG. 5 is a cross-sectional view of a coaxial cable core that includes a moisture-absorbent material within a central structural member supporting a plastic rod according to one embodiment of the invention.
Figure 6:
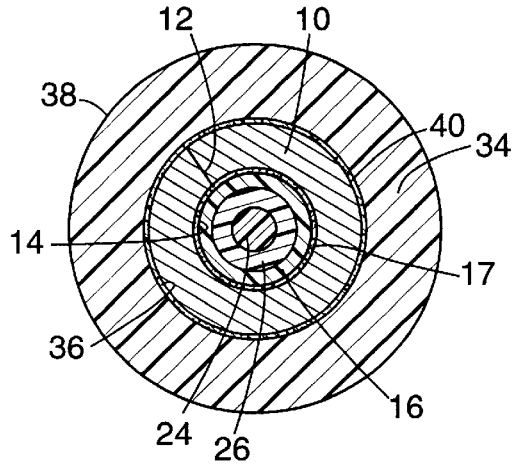
FIG. 6 is a cross-sectional view of a coaxial cable core that includes a moisture-absorbent material at an interface between a central structural member and a plastic rod according to one embodiment of the invention.

The plastic rod 16 illustrated in FIGS. 1–4 is a solid rod but can also be a hollow rod as illustrated in the preferred embodiment of FIGS. 5 and 6. In this case, the plastic rod 16 is preferably supported by a central structural member 24 adjacent an inner surface 26 of the plastic rod that facilitates the formation of the plastic rod. The central structural member 24 can include one or more reinforcing materials that combine to form a high tensile strength support for the plastic rod 16. Suitable reinforcing materials for the central structural member 24 include fiber reinforced plastic rods (e.g., glass), reinforced plastic cords (e.g. Kevlar reinforced nylon cords and reinforced epoxy resin cords) and metal wires (e.g. copper and aluminum wire). Preferably, the central structural member 24 is a glass fiber reinforced plastic rod.

As illustrated in FIG. 5 and as preferred in accordance with the invention, the moisture-absorbent material can be incorporated in the central structural member 24. The central structural member 24 can be impregnated with the moisture-absorbent material by contacting the central structural member with a dispersion or solution of the moisture-absorbent material and drying the central structural member. Alternatively, the central structural member 24 can include moisture-absorbent yarn or thread that has been coated with the water absorbent material using dispersions or solutions of these materials and drying the yarn or thread. The reinforcing material or yarn or thread provided in the central structural member 24 can also include more than one type of moisture-absorbent material having different characteristics or absorption rates to provide the benefits discussed above. For example, a first yarn impregnated with a first moisture-absorbent material and a second yarn impregnated with a second moisture-absorbent material can be provided in the central structural member 24. Alternatively, a first glass fiber reinforced plastic rod including a first moisture-absorbent material and a second glass fiber reinforced plastic rod including a second moisture-absorbent material can be formed into a twisted bundle to produce the central structural member 24.

FIG. 6 illustrates an alternative embodiment wherein a moisture-absorbent layer 26 is provided at the interface between the central structural member 24 and the plastic rod 16. Preferably, as discussed above, the moisture-absorbent material is tacky when applied to the central structural member 24 or it dispersed or dissolved in a suitable medium and applied to the central structural member 24. Alternatively, a textile material impregnated with the moisture-absorbent material can be applied around the central structural member 24 to form the moisture-absorbent layer 26.

Figure 7:
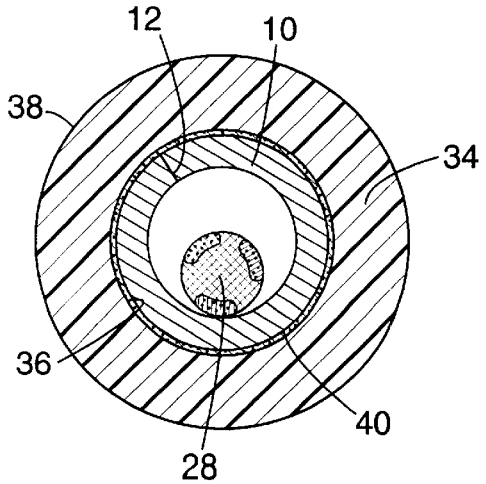
FIG. 7 is a cross-sectional view of a coaxial cable core that includes a moisture-absorbent material within a textile material according to one embodiment of the invention.

FIG. 7 illustrates another embodiment of the invention wherein a textile material 28 that includes the moisture-absorbent material is provided within the inner conductive tube 10. The textile material 28 can be a woven yarn that includes moisture-absorbent fibers such as cotton fibers, fibers that have been impregnated with a moisture-absorbent material using the methods discussed above, or a combination thereof. Moreover, additional moisture-absorbent materials can be provided with the textile material 28, e.g., by sewing or attaching packets 30 that include the additional moisture-absorbent material to the textile material. The textile material 28 acts as a wick to pull moisture away from the inner conductive tube thereby preventing corrosion of the tube.

Figure 8:
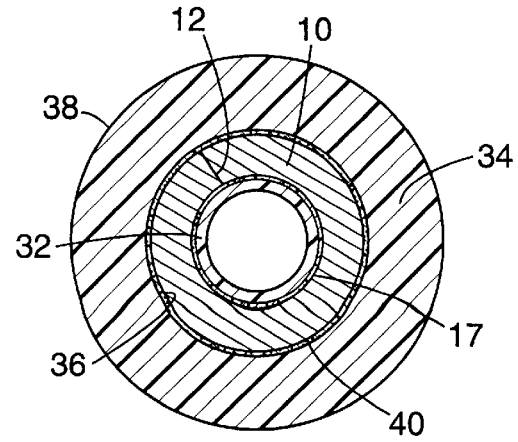
FIG. 8 is a cross-sectional view of a coaxial cable core that includes a moisture-absorbent material applied to the inner surface of an inner conductive tube according to one embodiment of the invention.

FIG. 8 illustrates yet another embodiment of the invention wherein a moisture-absorbent layer 32 is provided directly on the adhesive layer 17 or less preferably directly on the inner surface 14 of the inner conductive tube 10. The moisture-absorbent layer 32 can be applied as a tacky moisture-absorbent particulate material that adheres to the adhesive layer 17. Alternatively, the moisture-absorbent material can be dispersed or dissolved in a suitable medium and applied to the adhesive layer 17 and dried to form the moisture-absorbent layer 32. As discussed in more detail below, the moisture-absorbent layer 32 can also be applied to the adhesive layer 17 adjacent the metal strip S1 prior to forming the inner conductive tube 10.

As illustrated in FIGS. 1–8, the coaxial cable further comprises a dielectric layer 34 that surrounds the inner conductive tube 10. The dielectric layer 34 preferably forms a continuous cylindrical wall of plastic dielectric material adjacent the outer surface 36 of the inner conductive tube 10 but an air dielectric construction can also be used using polymeric material as spacers (e.g., disks). The dielectric layer 34 is preferably a low loss dielectric formed of a suitable plastic such as polyethylene, polypropylene, and polystyrene. Preferably, to reduce the mass of the dielectric per unit length and hence reduce the dielectric constant, the dielectric layer 34 is formed of an expanded cellular foam composition, and in particular, a closed cell foam composition because of its resistance to moisture transmission. Preferably, the cells of the dielectric layer 34 are uniform in size and less than 200 microns in diameter. One suitable foam dielectric is an expanded high-density polyethylene polymer such as described in commonly owned U.S. Pat. No. 4,104,481 to Wilkenloh et al. Additionally, expanded blends of high and low-density polyethylene are preferred for use as the foam dielectric. To reduce the dielectric constant of the dielectric layer 34, the foam dielectric has a density of less than about 0.28 g/cc, preferably, less than about 0.22 g/cc.

Although the dielectric layer 34 of the invention generally consists of a uniform layer of foam material, the dielectric layer can have a gradient or graduated density such that the density of the dielectric increases radially from the inner conductive tube 10 to the outer surface 38 of the dielectric layer, either in a continuous or a step-wise fashion. For example, although not illustrated, the dielectric layer 34 can be a foam-solid laminate dielectric that comprises a low-density foam dielectric layer surrounded by a solid dielectric layer. These constructions can be used to enhance the compressive strength and bending properties of the cable and permit reduced densities as low as 0.10 g/cc along the inner conductive tube 10. The lower density of the foam dielectric layer 34 along the inner conductive tube 10 enhances the velocity of RF signal propagation and reduces signal attenuation.

The dielectric layer 34 is typically bonded to the inner conductive tube 10 by a thin adhesive layer 40 such as the EAA copolymer described above. Additionally, the cable can include a thin solid polymer layer and another thin adhesive layer to protect the outer surface of the inner conductive tube 10 as it is collected on reels as described below. As illustrated in FIG. 1, the plastic rod 16, the inner conductive tube 10, the foam dielectric layer 34, and the corresponding adhesive layers form the cable core designated generally as 42.

Closely surrounding the cable core 42 is a tubular metallic outer sheath 44. The sheath 44 can be either smooth-walled or corrugated but is preferably a smooth-walled sheath that includes a longitudinal weld 46. This smooth-walled sheath 44 is generally characterized as being both mechanically and electrically continuous thus allowing the sheath to effectively serve to mechanically and electrically seal the cable against outside influences as well as to seal the cable against leakage of RF radiation. Alternatively, the sheath can be perforated to allow controlled leakage of RF energy for certain specialized radiating cable applications. The tubular metallic sheath 44 of the invention preferably employs a thin walled copper sheath as the outer conductor. Moreover, the tubular metallic sheath 44 has a wall thickness selected so as to maintain a T/D ratio (ratio of wall thickness to outer diameter) of less than 1.6 percent and preferably less than 1.0 percent or even 0.6 percent or lower. Preferably, the thickness of the metallic sheath 44 is less than 0.013 inch to provide the desired bending and electrical properties of the invention. The smooth-walled construction optimizes the geometry of the cable to reduce contact resistance and variability of the cable when connectorized and to eliminate signal leakage at the connector. Furthermore, the smooth-walled sheath 44 can generally be produced at a lower cost than corrugated sheaths.

The inner surface of the tubular sheath 44 is preferably continuously bonded throughout its length and throughout its circumferential extent to the outer surface 38 of the dielectric layer 34 by a thin adhesive layer 48. Preferably, the adhesive layer 48 comprises a random copolymer of ethylene and acrylic acid (EAA) as described above. The adhesive layer 48 should be made as thin as possible to avoid adversely affecting the electrical characteristics of the cable. Desirably, the adhesive layer 48 should have a thickness of about 0.001 inch or less.

The cable can also include a protective jacket 50 that generally surrounds the outer surface of the sheath 44. Suitable compositions for the outer protective jacket 50 include thermoplastic coating materials such as polyethylene, polyvinyl chloride, polyurethane and rubbers. Although the jacket 50 illustrated in FIG. 1 consists of only one layer of material, laminated multiple jacket layers may also be employed to improve toughness, strippability, burn resistance, the reduction of smoke generation, ultraviolet and weatherability resistance, protection against rodent gnaw through, strength resistance, chemical resistance and/or cut-through resistance. In the embodiment illustrated, the protective jacket 50 is bonded to the outer surface of the sheath 44 by an adhesive layer 52 to thereby increase the bending properties of the coaxial cable. Preferably, the adhesive layer 52 is a thin layer of adhesive, such as the EAA copolymer described above. Although an adhesive layer 52 is illustrated in FIG. 1, the protective jacket 50 can also be directly bonded to the outer surface of the sheath 44 to provide the desired bending properties of the invention.

Figure 9:
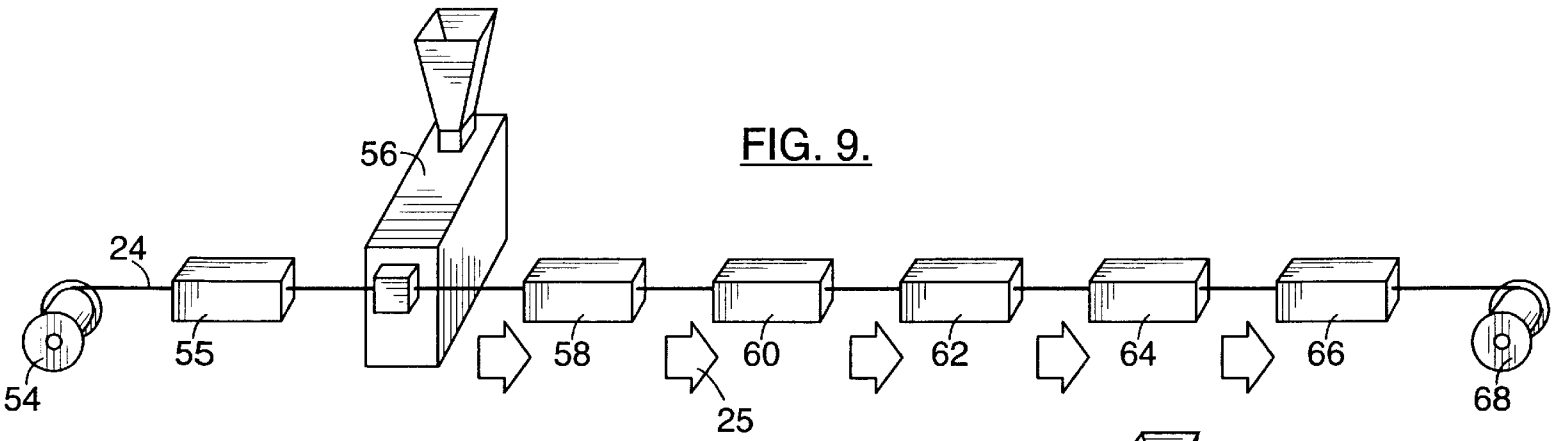
FIG. 9 is a schematic illustration of an apparatus for producing a plastic rod for use in the coaxial cable of the invention.
Figure 10:
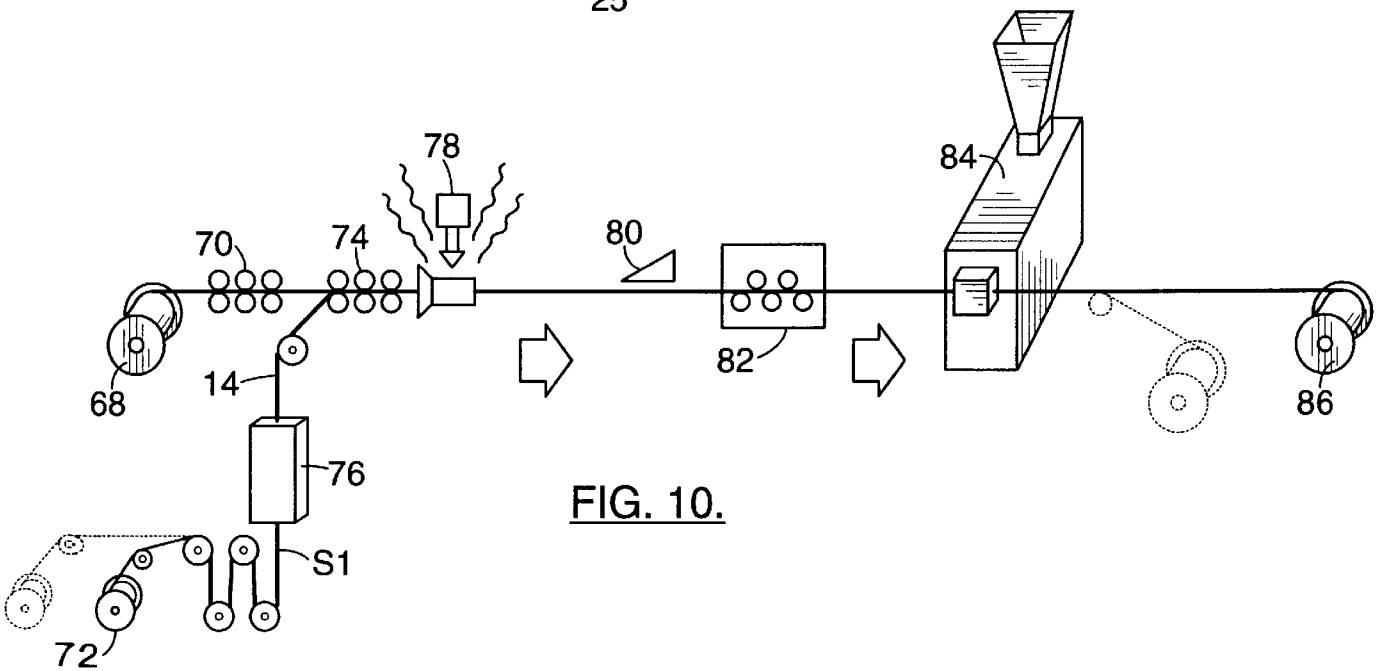
FIG. 10 is a schematic illustration of an apparatus for applying an inner conductive tube to a plastic rod for use in the coaxial cable of the invention.

FIGS. 9–10 illustrate a suitable arrangement of apparatus for providing a moisture-absorbent material within the inner conductive tube 10 in accordance with the invention. As illustrated in FIG. 9, a central structural member 24 can be advanced from a reel 54 along a predetermined path of travel illustrated by arrows 25. The central structural member 24 can be a glass fiber reinforced plastic rod, a reinforced plastic cord or a metallic wire and provides structural support for the plastic rod 16 and facilitates production of the rod. As stated above, the moisture-absorbent material can be incorporated in the central structural member 24. For example, the central structural member 24 can be advanced through a dispersion or solution containing a moisture-absorbent material to impregnate the central structural member with the moisture-absorbent material and then dried prior to forming the plastic rod 16 around the central structural member. Alternatively, the central structural member 24 can be impregnated with a moisture-absorbent material before it is wound on the reel 54. The central structural member 24 can also include moisture-absorbent yarn or thread that has been impregnated or coated with a moisture-absorbent material by contacting the yarn or thread with a dispersion or solution of the moisture-absorbent material and drying the yarn or thread. As stated above, the central structural member 24 can include more than one type of moisture-absorbent material. For example, reinforcing materials containing different moisture-absorbent materials can be fed from reels and twisted together or otherwise combined to produce the central structural member 24.

The central structural member 24 can optionally be coated with a moisture-absorbent layer 26 through the use of a suitable apparatus 55 prior to producing the plastic rod 16 around the central structural member. For example, the moisture-absorbent layer 26 can be produced by coating the central structural member 24 with a dispersion or solution containing the moisture-absorbent material. The moisture-absorbent layer 26 can also be extruded onto the central structural member 24 using an extruder apparatus 55. In addition, the central structural member 24 can be coated with a powder or other particulate moisture-absorbent material to form the moisture-absorbent layer 26. The particulate moisture-absorbent material is preferably tacky to provide adherence to the central structural member 24. Alternatively, a textile material such as a non-woven tape that is impregnated with a moisture-absorbent material can be applied around the central structural member 24 to provide the moisture-absorbent layer 26.

The central structural member 24 is advanced to an extruder apparatus 56 and crosshead die or similar device wherein a polymer composition is extruded concentrically around the advancing central structural member 24 to form the plastic rod 16. As described above, the polymer composition can be a nonfoamable or foamable polymer composition thereby forming a solid or foam plastic rod 16. If the central structural member 24 is not used, the extruder apparatus 56 can be adjusted to continuously extrude the polymer melt into either a continuous cylinder or, through the use of a vacuum sizer, into a hollow cylinder. If a foamable composition is used, the polymer melt in the extruder apparatus 56 is either injected with a blowing agent such as nitrogen or a chemical blowing agent is fed to the polymer melt to form the foamable polymer composition. In extruder apparatus 56, the polymer melt is continuously pressurized to prevent the formation of gas bubbles in the polymer melt. Upon leaving the extruder apparatus 56, the reduction in pressure causes the foamable polymer composition to foam and expand to form either a continuous or hollow foam plastic rod 16. Alternatively, if a non-foamable composition is used, the polymer material will harden and cool to form a solid plastic rod 16.

As described above, the moisture-absorbent material can be incorporated in the plastic rod 16. In this event, the moisture-absorbent material is typically fed to the extruder apparatus 56 either in the form of masterbatch pellets that include both the moisture-absorbent material and the plastic material forming the plastic rod 16 or the moisture-absorbent material can be added ahead of the extruder apparatus or directly to the melt to become incorporated in the plastic rod. When the moisture-absorbent material is incorporated in the plastic rod 16, the plastic rod is preferably foamed plastic to allow the moisture-absorbent material to contact any moisture that may be present in the cable.

As illustrated in FIG. 3, the plastic rod 16 can also include more than one plastic layer such as foam plastic layer 18 and solid plastic layer 20. The foam plastic layer 18 and solid plastic layer 20 are preferably coextruded by the extruder apparatus 56 with the foam plastic layer 18 extruded concentrically around the central structural member 24 and the solid plastic layer 20 extruded concentrically extruded around the foam plastic layer. Alternatively, the foam plastic layer 18 and solid plastic layer 20 can be extruded separately using successive extruder apparatuses. If the moisture-absorbent material is incorporated in the plastic rod 16, the moisture-absorbent material can be incorporated in the foam plastic layer 18, the solid plastic layer 20, or both. Preferably, the moisture-absorbent material is incorporated in the foam plastic layer 18 by the methods described above to allow the moisture-absorbent material to contact any moisture that may be present in the cable. If the foam plastic layer 18 and solid plastic layer 20 are extruded in successive extruder apparatuses, a moisture-absorbent layer can be applied around the foam plastic layer 18 by the methods discussed above and the solid plastic layer 20 extruded around the moisture-absorbent layer to produce the plastic rod 16.

As shown in FIG. 4, the moisture-absorbent material can also be provided as a moisture-absorbent layer 22 at the interface between the plastic rod 16 and the adhesive layer 17 adjacent the inner surface 14 of the inner conductive tube. The moisture-absorbent layer 22 can be applied to the plastic rod 16 through the use of a suitable apparatus 58 or can be applied adjacent the inner surface 14 of the strip S1 used to produce the inner conductive tube 10 as discussed below. The moisture-absorbent material can be applied to plastic rod 16 to produce the moisture-absorbent layer 22 by coating the plastic rod with a dispersion or solution containing the moisture-absorbent material. The moisture-absorbent layer 22 can also be extruded onto the plastic rod 16 using an extruder apparatus 58 and can even be coextruded with the plastic material used to form the plastic rod in the extruder apparatus 56. In addition, the plastic rod 16 can be coated with a powder or other particulate moisture-absorbent material to form the moisture-absorbent layer 22. The particulate moisture-absorbent material is preferably tacky to provide adherence to the plastic rod 16 and a sufficient amount of tackiness can be provided by applying the particulate moisture-absorbent material to the plastic rod while it is still slightly molten, i.e., right after extrusion of the plastic rod. Alternatively, a textile material such as a non-woven tape that is impregnated with a moisture-absorbent material can be applied around the plastic rod 16 to produce the moisture-absorbent layer 22.

The cables of the invention typically also include an adhesive layer 17 between the plastic rod 16 and the inner conductive tube 10. The adhesive layer 17 can be applied either to the plastic rod 16 or can be present on the inner surface 14 of the metal strip S1 used to form the inner conductive tube 10. When the adhesive layer 17 is applied to the plastic rod 16, an adhesive polymer composition is preferably coextruded concentrically around the plastic material used to form the plastic rod by the extruder apparatus 56. The adhesive composition can also be applied to the plastic rod 16 by a suitable apparatus 60 such as an extruder apparatus or by other suitable methods such as spraying or immersion especially if a moisture-absorbent layer 22 is provided on the outer surface 38 of the plastic rod 16.

After the adhesive layer 17 is applied to the plastic rod 16, the plastic rod can be directed through an adhesive drying station 62 such as a heated tunnel or chamber. Upon leaving the drying station 62, the plastic rod 16 is directed through a cooling station 64 such as a water trough. Water is then generally removed from the plastic rod 16 by an air wipe 66 or similar device. At this point, the adhesive coated plastic rod 16 can be collected on a suitable container, such as reels 68 prior to being further advanced through the portion of the manufacturing process illustrated in FIG. 10. Alternatively, the plastic rod 16 can be continuously advanced through the remainder of the manufacturing process without being collected on reels 68.

As illustrated in FIG. 10, the plastic rod 16 can be drawn from reels 68 and straightened by advancing the plastic rod through a series of straightening rolls 70. Alternatively, as illustrated in FIG. 7, a textile material 28 that includes a moisture-absorbent material can be used instead of the plastic rod and advanced through the process. A narrow elongate strip S1, preferably a copper strip, from a suitable supply source such as reel 72 is then directed around the advancing plastic rod 16 or textile material 28 and bent into a generally cylindrical form by guide rolls 74 so as to loosely encircle the plastic rod or textile material.

The surface of the strip S1 corresponding to the inner surface 14 of the inner conductive tube 10 can be coated with an adhesive composition to form the adhesive layer 17 and these strips are commercially available with adhesive coatings. The adhesive layer 17 adjacent the surface of the strip S1 corresponding to the inner surface 14 of the inner conductive tube 10 can be coated with a moisture-absorbent material to form the moisture-absorbent layer 22 or (if no plastic rod is included) the moisture-absorbent layer 32. For example, a moisture-absorbent material can be applied to the strip S1 through the use of a suitable apparatus 76 by coating the strip with a dispersion or solution containing the moisture-absorbent material. The strip S1 can also be coated with a powder or other particulate moisture-absorbent material to form the moisture-absorbent layer 22 or moisture-absorbent layer 32. The particulate moisture-absorbent material is preferably tacky to provide adherence to the strip S1 and a sufficient amount of tackiness can be provided by applying the particulate moisture-absorbent material to the adhesive layer 17 if still molten, i.e., right after application of the adhesive layer 17.

Once the strip S1 has been directed around the advancing plastic rod 16 or the textile material 28 (if either are present), opposing longitudinal edges of the strip S1 are then moved into abutting relation and the strip is advanced through a welding apparatus 78 which forms a longitudinal weld 12 by joining the abutting edges of the strip S1. Preferably, high frequency induction welding is used to form the longitudinal weld 12 but other welding means such gas tungsten arc welding or plasma arc welding can be employed to join the opposing longitudinal edges of the strip S1, or the strip can be overlapped around the plastic rod 16 to form the inner conductive tube 10.

The longitudinally welded strip S1 forms the inner conductive tube 10 loosely encircling the plastic rod 16. In the preferred high frequency induction welding process described above, the longitudinal weld 12 of the inner conductive tube 10 can then be directed against a scarfing blade 80 which scarfs weld flash from the inner conductive tube formed during the high frequency induction welding process. If increased compressive strength is desired to prevent buckling, flattening or collapsing of the inner conductive tube 10 during the scarfing process, the inner conductive tube can be formed into an oval configuration prior to directing the inner conductive tube against the scarfing blade 80 and then reshaped so that the inner conductive tube has a circular configuration.

The simultaneously advancing plastic rod 16 (if present) and the inner conductive tube 10 are advanced through at least one sinking die 82 which sinks the inner conductive tube 10 onto the plastic rod 16 and thereby causes compression of the plastic rod 16. A lubricant is preferably applied to the surface of the inner conductive tube 10 as it advances through the sinking die 82. If the plastic rod 16 is not used in accordance with the invention then the inner conductive tube typically is not subjected to the sinking die 82.

Once the inner conductive tube 10 has been formed, any lubricant on the outer surface of the inner conductive tube is removed to increase the ability of the inner conductive tube to bond to the dielectric layer 34. An adhesive layer 40 can then be formed onto the outer surface of the inner conductive tube 10 by advancing the plastic rod 16 and the surrounding inner conductive tube 10 through an extruder apparatus 84 where an adhesive composition such as an EAA copolymer is extruded concentrically onto the inner conductive tube to form the adhesive layer 40. In addition to the adhesive layer 40, a thin solid plastic layer and an adhesive composition forming adhesive layer can optionally be coextruded in the extruded apparatus 84 if desired to protect the inner conductive tube 10 when collected on reels 86. The plastic rod 16 and surrounding inner conductive tube 10 can then be quenched and dried, and collected on reels 86 before being further advanced through the portion of the process illustrated in FIG. 11 or can be directly advanced through the portion of the process illustrated in FIG. 11.

Figure 11:
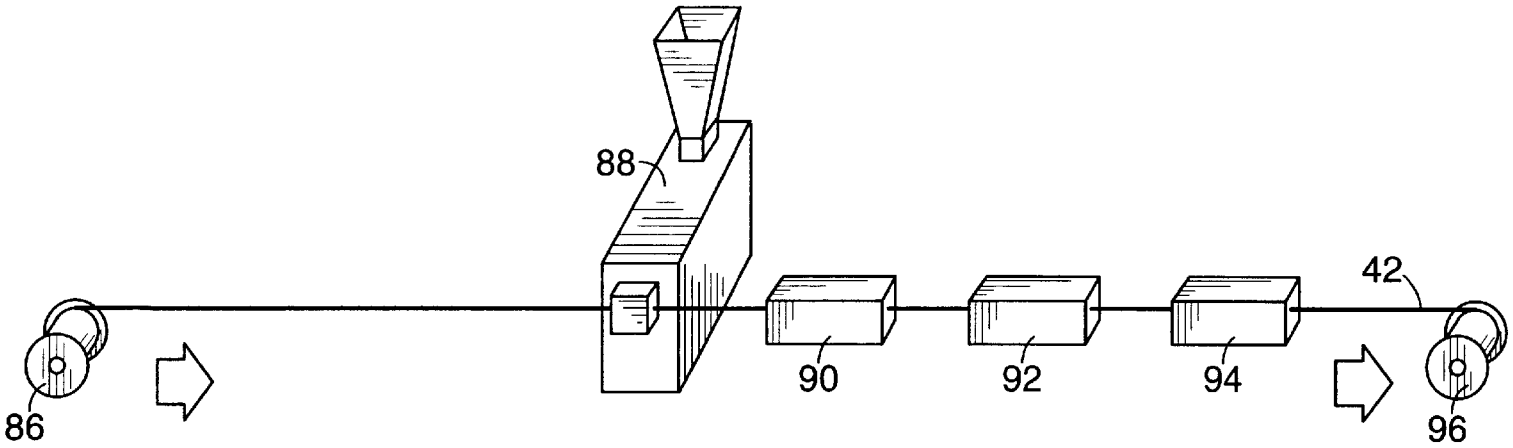
FIG. 11 is a schematic illustration of an apparatus for applying a dielectric and an adhesive composition on the surface of an inner conductive tube to form an adhesive coated cable core for the coaxial cable of the invention.

As illustrated in FIG. 11, the plastic rod 16 and surrounding inner conductive tube 10 can be advanced from reels 86 along a predetermined path of travel. The inner conductive tube 10 is then advanced through an extruder apparatus 88 that applies a polymer composition used to form the dielectric layer 34 adjacent the inner conductive tube. In the extruder apparatus 88, the components to be used for the dielectric layer 34 are combined to form a polymer melt. The polymer composition is preferably a foamable polymer composition therefore forming a foam dielectric layer 34. Preferably, high-density polyethylene and low-density polyethylene are combined in the extruder apparatus 88 to form the polymer melt. These compounds once melted together are subsequently injected with a blowing agent such as nitrogen to form the foamable polymer composition or a chemical blowing agent is added ahead of the extruder apparatus 88 or to the polymer melt. In addition to these blowing agents, a nucleating agent can be added to provide nucleation sites for the forming polymer cells. In extruder apparatus 88, the polymer melt is continuously pressurized to prevent the formation of gas bubbles in the polymer melt. The extruder apparatus 88 continuously extrudes the polymer melt concentrically around the advancing inner conductive tube 10. Upon leaving the extruder apparatus 88, the reduction in pressure causes the foamable polymer composition to foam and expand to form a continuous cylindrical foam dielectric layer 34 surrounding the inner conductive tube 10.

In addition to the foamable polymer composition, an adhesive composition such as an EAA copolymer is preferably coextruded with the foamable polymer composition to form adhesive layer 48. Extruder apparatus 88 continuously extrudes the adhesive composition concentrically around the polymer melt. Although coextrusion of the adhesive composition with the polymer melt is preferred, other suitable methods such as spraying, immersion, or extrusion in a separate apparatus may also be used to apply the adhesive composition to the dielectric layer 34.

To produce low foam dielectric densities along the inner conductive tube 10 of the cable, the method described above can be altered to provide a gradient or graduated density dielectric. For example, for a multilayer dielectric having a low density inner foam layer and a high density foam or solid outer layer, the polymer compositions forming the layers of the dielectric can be coextruded together and can further be coextruded with the adhesive composition forming adhesive layer 48. Alternatively, the dielectric layers can be extruded separately using successive extruder apparatuses. Other suitable methods can also be used. For example, the temperature of the inner conductive tube 10 may be elevated to increase the size and therefore reduce the density of the cells along the inner conductive tube to form a dielectric having a radially increasing density.

After leaving the extruder apparatus 88, the adhesive coated core 42 may be directed through an adhesive drying station 90 such as a heated tunnel or chamber. Upon leaving the drying station 90, the core is directed through a cooling station 92 such as a water trough. Water is then generally removed from the core 42 by an air wipe 94 or similar device. At this point, the adhesive coated core 42 may be collected on suitable containers, such as reels 96 prior to being further advanced through the remainder of the manufacturing process illustrated in FIG. 12. Alternatively, the adhesive coated core 42 can be continuously advanced through the remainder of the manufacturing process without being collected on reels 96.

Figure 12:
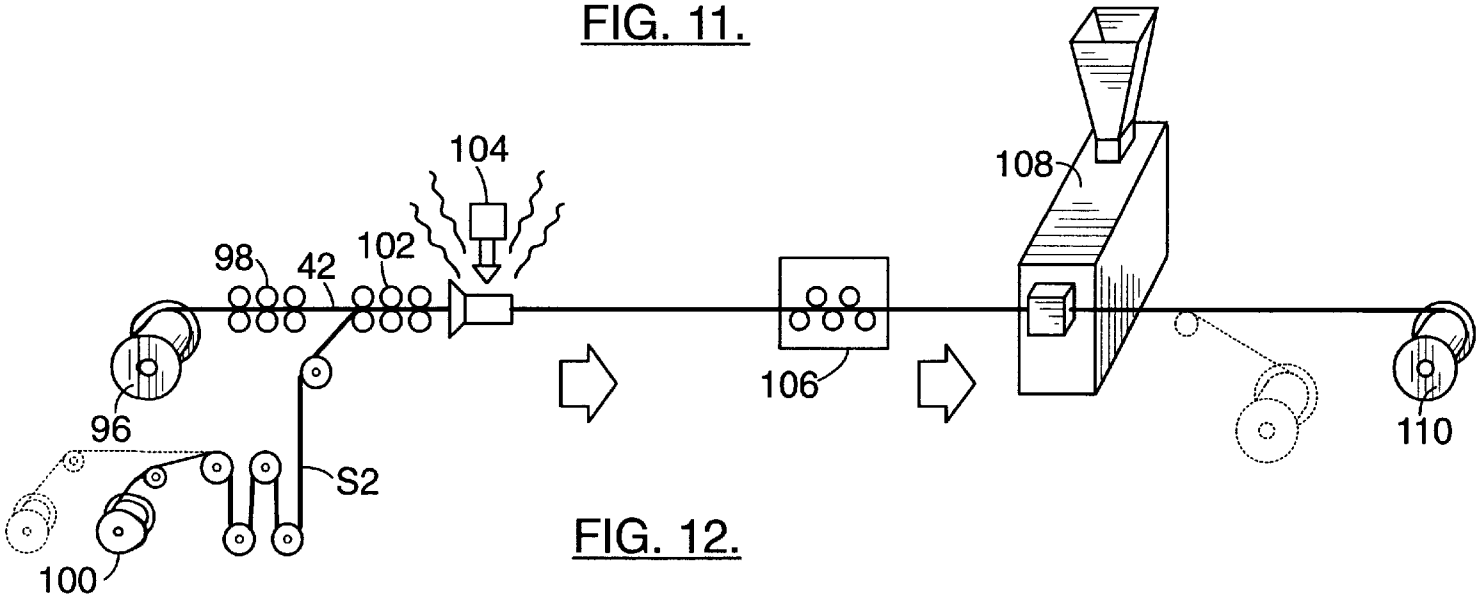
FIG. 12 is a schematic illustration of an apparatus for applying a sheath and optionally a jacket to an adhesive coated core to produce the coaxial cable of the invention.

As illustrated in FIG. 12, the adhesive coated core 42 can be drawn from reels 96 and further processed to form the coaxial cable. Typically, the adhesive coated core 42 is straightened by advancing the adhesive coated core through a series of straightening rolls 98. A narrow elongate strip S2 from a suitable supply source such as reel 100 is then directed around the advancing core and bent into a generally cylindrical form by guide rolls 102 so as to loosely encircle the core. Preferably, the strip S2 is formed of copper. Opposing longitudinal edges of the thus formed strip S2 are then moved into abutting relation and the strip is advanced through a welding apparatus 104 that forms a longitudinal weld 46 by joining the abutting edges of the strip S2. The longitudinally welded strip forms an electrically and mechanically continuous sheath 44 loosely surrounding the core 42. Preferably, a gas tungsten arc weld is formed to join the opposing longitudinal edges of the strip S2 but other welding methods such as plasma arc welding or high frequency induction welding (coupled with scarfing of weld flash) can also be used to form the longitudinal weld 46 in the sheath 44.

Once the longitudinal weld 46 is formed in the sheath 44, the simultaneously advancing core 42 and the sheath are advanced through at least one sinking die 106 that sinks the sheath onto the cable core and thereby causes compression of the dielectric layer 34. A lubricant is preferably applied to the surface of the sheath 44 as it advances through the sinking die 106. Once the sheath has been formed on the core 42, any lubricant on the outer surface of the sheath is removed to increase the ability of the sheath to bond to the protective jacket 50. An adhesive layer 52 and the protective jacket 50 are then formed onto the outer surface of the sheath 44. In the present invention, the outer protective jacket 50 is provided by advancing the core 42 and surrounding sheath 44 through an extruder apparatus 108 where a polymer composition is extruded concentrically in surrounding relation to the adhesive layer 52 to form the protective jacket 50. Preferably, a molten adhesive composition such as an EAA copolymer is coextruded concentrically in surrounding relation to the sheath 44 with the polymer composition, which is in concentrically surrounding relation to the molten adhesive composition to form the adhesive layer 52 and protective jacket 50. Where multiple polymer layers are used to form the jacket 50, the polymer compositions forming the multiple layers may be coextruded together in surrounding relation and with the adhesive composition forming adhesive layer 52 to form the protective jacket. Additionally, a longitudinal tracer stripe of a polymer composition contrasting in color to the protective jacket 50 may be coextruded with the polymer composition forming the jacket for labeling purposes.

The heat of the polymer composition forming the protective jacket 50 serves to activate the adhesive layer 48 to form an adhesive bond between the inner surface of sheath 44 and the outer surface of the dielectric layer 34. Once the protective jacket 50 has been applied, the coaxial cable is subsequently quenched to cool and harden the materials in the coaxial cable. Once the coaxial cable has been quenched and dried, the thus produced cable may then be collected on suitable containers, such as reels 110, suitable for storage and shipment.

Figure 13:
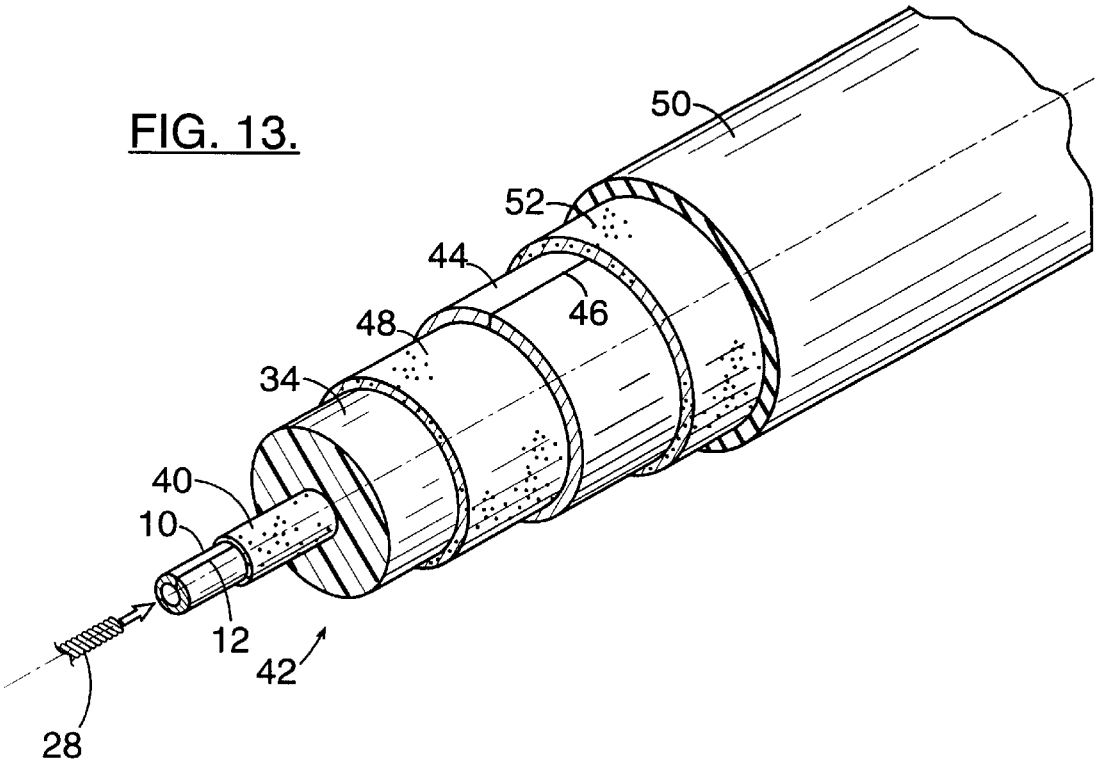
FIG. 13 is a perspective view showing a coaxial cable in accordance with the present invention in cross-section and demonstrating the insertion of a moisture-absorbent textile material into the inner conductive tube.

Although the moisture-absorbing material can be provided within the inner conductive tube 10 during the manufacture of the cable, as illustrated in FIG. 13, a moisture-absorbent material can also be installed within the inner conductive tube during connectorization of the cable. In particular, during connectorization of the cables, a moisture-absorbent material such as the textile material 28 illustrated in FIG. 7 can be inserted into an end portion of the coaxial cable. When the moisture-absorbent material is installed within the inner conductive tube 10 during installation or connectorization of the cable, the moisture-absorbent material does not have to extend through the full length of the cable. Rather, only a sufficient amount of moisture-absorbent material needs to be inserted to absorb for the amount of moisture that may enter the cable during installation or connectorization. For example, 2 to 50 feet of moisture-absorbent material can be installed into an end portion of the cable (e.g., a connectorized end) to provide the desired amount of moisture absorption. Alternatively, where a "drip loop" is incorporated in the cable during installation to collect ingressed water or condensed water vapor, the textile material 28 can be inserted in the low point of the "drip loop."

The cables of the invention have the ability to absorb moisture that enters the cable such as during connectorization and installation of the cable. In particular, the moisture-absorbent material within the inner conductive tube of the cable 10 binds any moisture present in the cable thus preventing the moisture from corroding the cable conductors and negatively affecting the mechanical and electrical properties of the cable. Furthermore, because the moisture-absorbent material is preferably provided away from the inner surface 14 of the inner conductive tube 10, there is even less chance for corrosion in the cable. Moreover, absorbing moisture within the inner conductive tube 10 keeps the moisture away from the outer surface of the inner conductive tube and from the inner surface of the sheath where the majority of the electrical signals are propagated.

Furthermore, the coaxial cables of the present invention are beneficially designed to possess excellent bending properties. Specifically, the coaxial cables of the invention are designed to limit buckling, flattening or collapsing of the inner conductive tube 10 and the outer metallic sheath 44 during bending of the cable. During bending of the cable, one side of the cable is stretched and subject to tensile stress and the opposite side of the cable is compressed and subject to compressive stress. If the plastic rod 16 and core 42 are sufficiently stiff in radial compression and the local compressive yield loads of the inner conductive tube 10 and sheath 44 are sufficiently low, the tensioned sides of the inner conductive tube and sheath will elongate by yielding in the longitudinal direction to accommodate the bending of the cable. Accordingly, the compression sides of the inner conductive tube 10 and sheath 44 preferably shorten to allow bending of the cable. If the compression sides of the plastic rod and sheath do not shorten, the compressive stress caused by bending the cable can result in buckling of either the inner conductive tube or the sheath.

The polymer layers located on the compression side and tension sides of the inner conductive tube 10 and the outer metallic sheath 44 provide support for the inner conductive tube and sheath in bending. Furthermore, the adhesive layers 17, 40, 48 and 52 not only facilitate bonding between the polymer layers and the inner conductive tube 10 and sheath 44 but also further support the inner conductive tube and sheath in bending. Therefore, the plastic rod 16, the foam dielectric layer 34, and the corresponding adhesive layers prevent buckling, flattening or collapsing of the inner conductive tube 10 and sheath 44 during bending.

In addition to increasing the bending properties of the inner conductive tube 10, the plastic rod 16 provides other benefits in the coaxial cables of the invention. Specifically, the plastic rod 16 allows a thin strip of metal to be used as the inner conductive tube 10 in the coaxial cables of the invention, and at a much lower cost than the corrugated inner conductive tubing used in conventional high diameter cables. Furthermore, the plastic rod 16 can prevent or greatly reduce the migration of water in the coaxial cable and specifically within the inner conductive tube 10. The adhesive layers and the foam dielectric layer 34 in the cable also provide the benefit of preventing the migration of water through the cable and generally provide the cable with increased bending properties. Moreover, because smooth-walled conductors can be used throughout the cables of the invention, the cables can be easily connectorized during installation, especially compared to similar cables having corrugated inner and outer conductors.

The coaxial cables of the present invention have enhanced bending characteristics over conventional coaxial cables. The coaxial cables of the invention are particularly useful in large diameter, low loss coaxial cables having a sheath diameter of 1.0 inches or more. In these cables the solid inner conductive tube used in conventional cables can be replaced with an inner conductive tube 10. As high frequency signals are carried on the outside surface of the inner conductive tube, this replacement does not decrease the propagative properties of the cable. Moreover, the bending properties of the cable are not decreased as the inner conductive tube 10 is supported in bending by the plastic rod 16. Therefore, the amount of conductive material is reduced and hence, so is the cost of the material used in the cable. Accordingly, the coaxial cables can be used for high frequency RF applications, e.g., 50-ohm applications. Although the coaxial cables of the invention have found utility in large diameter cable applications, the coaxial cables of the invention can also be used in smaller diameter cables, i.e., cables having a diameter of less than 1.0 inches, to produce the same benefits described above.

The excellent bending properties of the coaxial cables of the invention are further demonstrated by the fact that these cables have a core to sheath stiffness ratio of at least 5, and preferably of at least 10. In addition, the minimum bend radius in the coaxial cables of the invention is significantly less than 10 cable diameters, more on the order of about 7 cable diameters or lower. Furthermore, the tubular sheath wall thickness of the cable is such that the ratio of the wall thickness to its outer diameter (T/D ratio) is no greater than about 1.6 percent and preferably no greater than about 1.0 percent, and more preferably no greater than 0.6 percent. The reduced wall thickness of the sheath contributes to the bending properties of the coaxial cable and advantageously reduces the attenuation of RF signals in the coaxial cable.

It is understood that upon reading the above description of the present invention, one skilled in the art could make changes and variations therefrom. These changes and variations are included in the spirit and scope of the following appended claims.

That which is claimed:

1. A coaxial cable comprising an inner conductive tube; a plastic rod adjacent an inner surface of the inner conductive tube, the plastic rod comprising a foamed polymeric layer and a solid polymeric layer surrounding the foamed polymeric layer and adjacent an inner surface of the inner conductive tube; and a moisture-absorbent material provided on an interface between said foamed polymeric layer and said solid polymeric layer.

2. The coaxial cable according to claim 1 further comprising a dielectric surrounding the inner conductive tube and a tubular metallic outer sheath surrounding the dielectric.

3. The coaxial cable according to claim 2 wherein said dielectric comprises a foam polymer dielectric.

4. The coaxial cable according to claim 1 further comprising a moisture-absorbent material between said plastic rod and said inner conductive tube.

5. The coaxial cable according to claim 1 wherein the plastic rod is a hollow rod and the coaxial cable further comprises a central structural member adjacent an inner surface of said plastic rod and supporting said plastic rod.

6. The coaxial cable according to claim 5 wherein a moisture-absorbent material is provided within said central structural member.

7. The coaxial cable according to claim 5 wherein a moisture-absorbent material is provided on an interface between said central structural member and the inner surface of said plastic rod.

8. The coaxial cable according to claim 5 wherein the central structural member is a glass fiber reinforced plastic rod.

9. The coaxial cable according to claim 5 wherein the central structural member is a metal wire.

10. The coaxial cable according to claim 1 wherein said plastic rod is adhesively bonded to the inner surface of the inner conductive tube.

11. The coaxial cable according to claim 1 wherein said inner conductive tube is a smooth-walled tube.

12. The coaxial cable according to claim 1, wherein said inner conductive tube is continuous.

13. The coaxial cable according to claim 1, wherein said plastic rod is formed of a material selected from the group consisting of polyethylene, polypropylene and polystyrene.

14. The coaxial cable according to claim 1, wherein said plastic rod is formed of a material that will support said inner conductive tube in bending and contribute to the overall compressive strength of said cable.

15. The coaxial cable according to claim 1, wherein said plastic rod is extruded.

16. The coaxial cable according to claim 1, wherein the inner conductive tube is formed of a continuous longitudinally welded copper strip.

17. A coaxial cable comprising an inner conductive tube; a hollow plastic rod adjacent an inner surface of the inner conductive tube; a central structural member adjacent an inner surface of said plastic rod and supporting said plastic rod, wherein said central structural member includes more than one moisture absorbing material, each of said moisture-absorbent materials having a different rate of moisture absorbency; a dielectric surrounding the inner conductive tube, and a tubular metallic outer sheath surrounding the dielectric.

18. The coaxial cable according to claim 17, wherein said dielectric comprises a foam polymer dielectric.

19. The coaxial cable according to claim 17, further comprising a moisture-absorbent material between said plastic rod and said inner conductive tube.

20. The coaxial cable according to claim 17, wherein the plastic rod comprises a foamed polymeric material.

21. The coaxial cable according to claim 17, wherein the plastic rod comprises a foamed polymeric layer and a solid polymeric layer surrounding the foamed polymeric layer and adjacent the inner surface of the inner conductive tube.

22. The coaxial cable according to claim 17, wherein the central structural member is a glass fiber reinforced plastic rod.

23. The coaxial cable according to claim 17, wherein the central structural member is a metal wire.

24. The coaxial cable according to claim 17, wherein said plastic rod is adhesively bonded to the inner surface of the inner conductive tube.

25. The coaxial cable according to claim 17, wherein said inner conductive tube is a smooth-walled tube.

26. The coaxial cable according to claim 17, wherein said inner conductive tube is continuous.

27. The coaxial cable according to claim 17, wherein said plastic rod is formed of a material selected from the group consisting of polyethylene, polypropylene and polystyrene.

28. The coaxial cable according to claim 17, wherein said plastic rod is formed of a material that will support said inner conductive tube in bending and contribute to the overall compressive strength of said cable.

29. The coaxial cable according to claim 17, wherein said plastic rod is extruded.

30. The coaxial cable according to claim 17, wherein the inner conductive tube is formed of a continuous logitudinally welded copper strip.

31. A coaxial cable comprising a desiccant-filled reinforcing member; a cylindrical plastic rod surrounding said desiccant-filled reinforcing member; a smooth-walled inner conductive tube surrounding said cylindrical plastic rod, a foam polymer layer surrounding the inner conductive tube and adhesively bonded thereto, a smooth-walled tubular copper outer sheath closely surrounding the foam polymer dielectric layer, and a protective polymer jacket surrounding said outer sheath and adhesively bonded thereto.

* * * * *